US011359383B2

(12) United States Patent
Carlson et al.

(10) Patent No.: US 11,359,383 B2
(45) Date of Patent: Jun. 14, 2022

(54) HIDDEN FASTENER ASSEMBLY FOR ATTACHING GROOVED DECK MEMBERS

(71) Applicant: OMG, Inc., Agawam, MA (US)

(72) Inventors: Logan Carlson, Wilbraham, MA (US); Timothy F. Gillis, Florence, MA (US); Mitchell T. Kraucunas, Enfield, CT (US); Peter Barenski, Jr., Stockbridge, MA (US); Frederick A. Enko, Westfield, MA (US); Anthony DiSanto, Holyoke, MA (US); Mark J. Guthrie, West Springfield, MA (US)

(73) Assignee: OMG, Inc., Agawam, MA (US)

( * ) Notice: Subject to any disclaimer, the term of this patent is extended or adjusted under 35 U.S.C. 154(b) by 71 days.

(21) Appl. No.: 16/856,140

(22) Filed: Apr. 23, 2020

(65) Prior Publication Data

US 2020/0340252 A1 Oct. 29, 2020

Related U.S. Application Data

(60) Provisional application No. 62/837,366, filed on Apr. 23, 2019.

(51) Int. Cl.
*E04B 1/38* (2006.01)
*E04B 5/00* (2006.01)
(Continued)

(52) U.S. Cl.
CPC ..... *E04F 15/02038* (2013.01); *E04B 5/02* (2013.01); *E04F 2201/023* (2013.01); *E04F 2201/0517* (2013.01)

(58) Field of Classification Search
CPC ..... E04F 15/2038; E04F 15/2044; E04F 2201/023; E04F 2201/0517; E04B 5/02;
(Continued)

(56) References Cited

U.S. PATENT DOCUMENTS 1,407,709 A * 2/1922 Tibbals ..... F16B 15/08 411/444
1,714,738 A * 5/1929 Smith ..... E04F 15/04 52/512
(Continued)

OTHER PUBLICATIONS

"TurboClip Universal Hidden Fastener 1/4" Deck Clip for Composite Grooved Boards," retrieved from https://www.ebay.com/itm/TurboClip-Universal-Hidden-Fastener-1-4-Deck-Clip-for-Composite-Grooved-Boards-/352715465168, Jan. 9, 2020.
(Continued)

*Primary Examiner* — Brian E Glessner
*Assistant Examiner* — James J Buckle, Jr.
(74) *Attorney, Agent, or Firm* — Alix, Yale & Ristas, LLP

(57) ABSTRACT

A hidden fastener assembly facilitates the attachment of grooved deck members to a joist. A body has an upper platform and a lower reference surface and is traversed by a central opening. A pair of tongues project from the body and are positioned and configured for reception in the grooves of the deck members. A pair of legs straddle the joist to aid in positioning. A fastener received in the opening and driven into the joist secures the deck members to the joist at a desired spacing. The fastener assemblies may be collated for usage in automatic driving tools.

20 Claims, 8 Drawing Sheets

(51) Int. Cl.
*E04F 15/02* (2006.01)
*E04B 5/02* (2006.01)

(58) Field of Classification Search
CPC ..... E04B 5/023; F16B 15/02; F16B 15/0023; F16B 15/0038; F16B 15/08; F16B 5/002
USPC ..... 52/410, 489.1, 512
See application file for complete search history.

(56) References Cited

U.S. PATENT DOCUMENTS 2,849,715 A 9/1958 Kopf
2,886,815 A 5/1959 Young
2,946,060 A 7/1960 Powers
3,181,662 A 5/1965 Maertzig, Jr.
3,363,817 A 1/1968 Brack
3,473,719 A 10/1969 Jephson
3,633,810 A 1/1972 Krakauer
3,741,455 A 6/1973 Wandel et al.
3,923,226 A 12/1975 Maier
3,923,227 A 12/1975 Maier
4,220,070 A * 9/1980 Anstett ..... F16B 15/08 411/444
4,339,065 A 7/1982 Haytayan
4,424,929 A 1/1984 Weis
4,485,952 A 12/1984 Weis
4,509,668 A 4/1985 Klaus et al.
4,809,568 A 3/1989 DeCaro
5,025,968 A 6/1991 Nasiatka
5,042,142 A 8/1991 Beach et al.
5,238,167 A 8/1993 Howard et al.
5,378,102 A 1/1995 Mossman
5,502,942 A 4/1996 Gras et al.
5,642,597 A 7/1997 Hendrickson
5,774,949 A * 7/1998 Cornell ..... F16B 5/123 24/289
5,803,338 A 9/1998 Singer et al.
6,142,352 A 11/2000 Larson et al.
6,273,316 B1 8/2001 Losada
6,314,699 B1 11/2001 West
6,402,415 B1 6/2002 Eberle, III
6,598,775 B1 7/2003 Chen
6,711,809 B1 3/2004 Fischer et al.
6,761,299 B2 7/2004 Caringella et al.
6,779,697 B2 8/2004 Lin
6,810,633 B2 11/2004 Harris, Sr.
6,871,467 B2 3/2005 Hafner
6,908,022 B2 6/2005 Schmitz
6,932,261 B2 8/2005 Huang
7,052,200 B2 5/2006 Harris
7,111,767 B2 9/2006 Losada
7,287,681 B1 10/2007 Wen
7,546,717 B2 6/2009 Juan Puerta
7,644,556 B2 1/2010 Grohman et al.
D612,708 S 3/2010 Fattori et al.
D612,709 S 3/2010 Fattori et al.
D613,593 S 4/2010 King
7,739,807 B2 6/2010 Grant
D625,989 S 10/2010 Mancosh et al.
7,805,902 B2 10/2010 Martel
D629,284 S 12/2010 Loftus
D632,164 S 2/2011 Lappin
7,882,994 B2 2/2011 Francescon
7,908,812 B2 3/2011 Eberle, III
7,908,816 B2 3/2011 Grafenauer et al.
7,984,599 B2 7/2011 Snell et al.
D643,706 S 8/2011 Lappin et al.
D643,707 S 8/2011 Lappin et al.
8,011,153 B2 9/2011 Orchard
8,146,303 B2 4/2012 Gibson et al.
8,158,044 B2 4/2012 Grohman
8,161,702 B2 4/2012 Eberle, III
8,256,614 B1 9/2012 Wadsworth, Sr.
8,376,203 B2 2/2013 Martel et al.
8,393,125 B2 3/2013 Martel
8,534,526 B2 9/2013 Orchard
8,555,570 B2 10/2013 Martel
8,672,600 B2 * 3/2014 Reznar ..... E04F 15/04 411/457
9,073,295 B2 7/2015 Przybylinski et al.
9,145,673 B1 9/2015 Dantzer
9,181,715 B2 11/2015 Orchard
9,205,536 B2 12/2015 Clark
9,228,362 B2 1/2016 Eberle, III
9,290,889 B2 3/2016 Choo
9,416,546 B2 8/2016 Claudin
9,555,529 B2 1/2017 Ronconi
9,637,934 B2 5/2017 Wadsworth
D792,757 S 7/2017 Brigham et al.
9,700,931 B2 7/2017 Wadsworth
D795,049 S 8/2017 Brigham et al.
9,822,809 B2 * 11/2017 Shadwell ..... E04F 15/02044
9,850,667 B2 12/2017 Engstrom
9,868,147 B2 1/2018 Wadsworth
9,963,886 B2 5/2018 Mitchell
10,113,306 B2 10/2018 Brigham et al.
10,145,404 B2 12/2018 Shadwell
10,174,496 B2 1/2019 Bertato
10,214,896 B2 2/2019 Tebo
D850,897 S 6/2019 Vandenberg
10,309,099 B2 6/2019 Brigham et al.
10,315,295 B2 6/2019 Vandenberg
D853,829 S 7/2019 Vandenberg
10,378,218 B2 * 8/2019 Vandenberg ..... F16B 5/0088
10,407,898 B2 9/2019 Tebo
10,487,460 B2 11/2019 Lee
10,895,080 B1 * 1/2021 MacKenzie ..... E04F 15/02183
10,988,931 B1 * 4/2021 McManus ..... E04B 5/14
2002/0007537 A1 * 1/2002 Lubera ..... B60R 13/0212 24/293
2002/0059766 A1 5/2002 Gregor
2002/0112438 A1 * 8/2002 Little ..... F16B 9/058 52/702
2003/0121226 A1 7/2003 Bolduc
2004/0045244 A1 * 3/2004 Hafner ..... E04B 5/12 52/489.1
2004/0244325 A1 * 12/2004 Nelson ..... E04F 15/04 52/582.1
2005/0028473 A1 2/2005 Grohman
2006/0059822 A1 * 3/2006 Guffey ..... F16B 5/002 52/480
2007/0289249 A1 12/2007 Martel
2009/0019805 A1 * 1/2009 Zanelli ..... E04F 15/02 52/489.1
2010/0083610 A1 4/2010 King
2011/0073824 A1 3/2011 Lappin et al.
2011/0197538 A1 * 8/2011 Martel ..... E04F 15/04 52/650.3
2011/0314765 A1 * 12/2011 Martel ..... F16B 12/00 52/745.05
2012/0110944 A1 5/2012 Hess
2013/0014465 A1 * 1/2013 Kilgore ..... E04F 15/02183 52/650.3
2013/0025228 A1 * 1/2013 Kilgore ..... E04F 15/04 52/578
2013/0340377 A1 * 12/2013 Shadwell ..... E04F 15/02044 52/698
2014/0007525 A1 * 1/2014 Wright ..... E04F 15/04 52/127.4
2014/0021236 A1 * 1/2014 Martel ..... F16B 5/002 227/18
2014/0174025 A1 6/2014 Kinnunen et al.
2015/0044434 A1 2/2015 Kotiadis et al.
2015/0275951 A1 * 10/2015 Shadwell ..... F16B 15/0038 411/511
2015/0354204 A1 12/2015 Kinnunen et al.
2016/0362902 A1 12/2016 Lee et al.
2017/0106513 A1 4/2017 Orchard
2017/0321434 A1 * 11/2017 Shadwell ..... E04F 15/02183
2018/0223547 A1 8/2018 Demuth et al.
2018/0238060 A1 8/2018 Doupe et al.
2019/0048578 A1 2/2019 Emerson
2019/0055738 A1 2/2019 Vandenberg

(56) References Cited

U.S. PATENT DOCUMENTS

| | | | |
|---|---|---|---|
| 2019/0055974 | A1* | 2/2019 | Vandenberg ..... E04F 15/02044 |
| 2019/0071880 | A1 | 3/2019 | Demuth et al. |
| 2019/0112802 | A1 | 4/2019 | Brigham et al. |
| 2019/0136502 | A1 | 5/2019 | Bertato |
| 2019/0136546 | A1 | 5/2019 | Doupe et al. |
| 2019/0186130 | A1 | 6/2019 | Penewell |
| 2019/0211856 | A1 | 7/2019 | Getsiv |
| 2019/0271161 | A1 | 9/2019 | Culp et al. |
| 2019/0284796 | A1 | 9/2019 | Bowker |
| 2019/0309527 | A1 | 10/2019 | Bergelin et al. |
| 2019/0360214 | A1 | 11/2019 | Vandenberg et al. |
| 2020/0087925 | A1 | 3/2020 | Vandenberg et al. |
| 2020/0340252 | A1 | 10/2020 | Carlson et al. |
| 2020/0362570 | A1 | 11/2020 | Vandenberg et al. |

OTHER PUBLICATIONS

"TurboClip. Universal Hidden Deck Clip," retrieved Feb. 5, 2019.
"Hidden Fasteners and Composite Saw Blades," retrieved from https://www.trex.com/products/accessory-hardware/, Dec. 12, 2018.
"Discover the hidden beauty of Hidden Deck Fasteners," retrieved from http://www.panamericanscrew.com/products/BROWSE_BRAND/SURE_DRIVE/HIDDEN_DECK_FASTENERS.aspx, Dec. 12, 2018.
"Coyote Clip Installation Instructions," retrieved before Mar. 26, 2020.
"Coyote Clip Hidden Fasteners—Pan American Screw," retrieved from http://www.panamericanscrew.com/products/BROWSE_BRAND/SURE_DRIVE/HIDDEN_DECK_FASTENERS/COYOTE_CLIP_HIDDEN_DECK_FASTENER/, Dec. 12, 2018.

* cited by examiner

HIDDEN FASTENER ASSEMBLY FOR ATTACHING GROOVED DECK MEMBERS

BACKGROUND

This disclosure relates generally to deck plank fastener assemblies for securing a deck plank to a joist and for positioning the deck planks. More particularly, this disclosure relates to hidden fastener assemblies for use with deck planks having side grooves.

Numerous hidden fastener deck plank assemblies have been proposed which both secure the deck plank to the underlying joist and which also define a uniform positioning of the adjacent deck plank. It is desirable that such hidden fastener assemblies be adapted for use with a collated series of fastener units to facilitate automatic driving of the fastener. It is also highly desirable that the fastener clips be configurable in a compact configuration for storage and transportation to the installation site.

SUMMARY

Briefly stated, a clip for positioning and securing adjacent grooved planks to a joist in a preferred form comprises a body having an upper platform and defining a central opening for a fastener. The body has generally uniformly laterally spaced sides and an underside forming a reference. A pair of parallel transversely extending retainers laterally project from a platform wing outwardly relative to the sides. The retainers are receivable in a plank groove. A pair of spaced legs project from the reference underside. The legs are transversely spaced a distance equal to the width of the joist and are equidistantly spaced from the central opening. Two equidistantly spaced pairs of opposed shoulders having a lower surface coplanar with the reference underside are provided. The clip is mountable to a joist so that the underside rests on the joist, the joist is captured between the legs, and a retainer is received in a plank groove. A fastener driven through the opening into the joist at a medial position secures the plank in position.

The opening has an enlarged upper throat. The body has transversely spaced edges contoured and configured so that the clip can be easily manually gripped and positioned. Each retainer is contoured to facilitate entry into the plank groove. The clip defines laterally spaced opposed pairs of indexing slots. Each shoulder has an upper tapered surface. The clip is preferably manufactured from a rugged plastic material. A plurality of clips are joined by a connector connecting adjacent retainers to form a strip of clips. The strip of clips may be wound into a spool.

DETAILED DESCRIPTION

Figure 1:
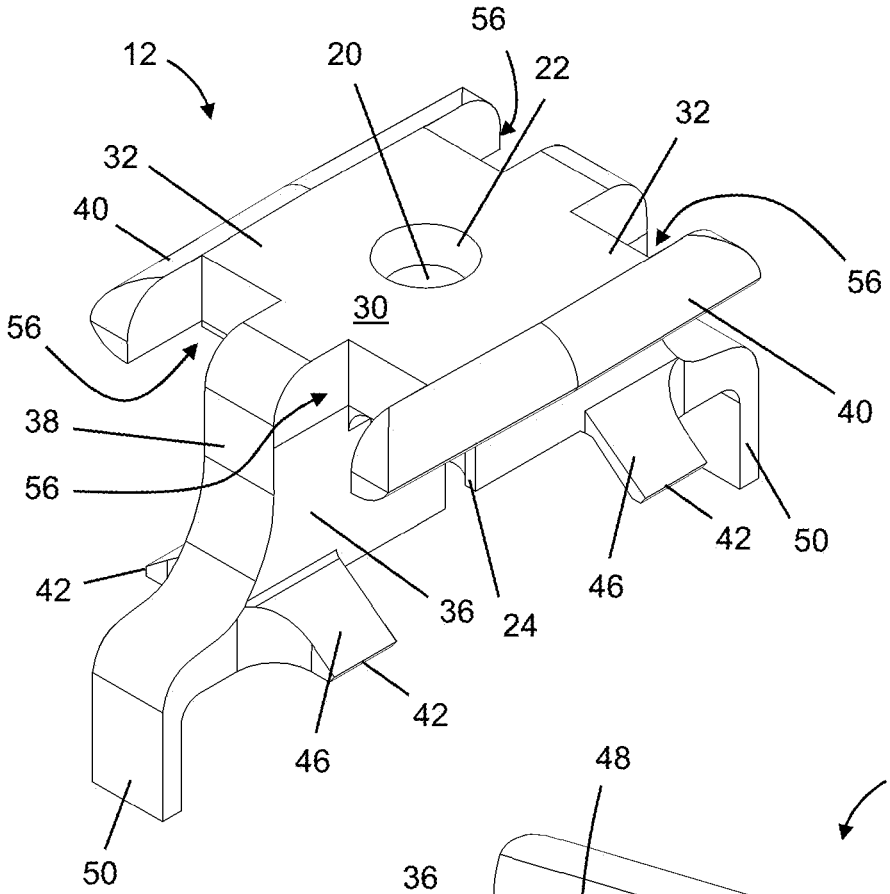
FIG. 1 is a perspective view of a clip for a hidden fastener assembly.

With reference to the drawings wherein like numerals represent like parts throughout the figures, a hidden fastener assembly for attaching grooved planks P to a support joist J is generally designated by the numeral 10. Each fastener assembly 10 comprises a clip 12 which engages a groove G of the deck plank P and rests on the joist J and a fastener 14. The fastener is driven into the clip and the joist J at a medial entry location. The clip 12 functions to secure the deck plank in proper position to the joist and also provides a reference for spacing the succeeding adjacent deck plank of the installation (See FIG. 6). The clip 12 is preferably manufactured from a rugged plastic material. The material may be translucent or transparent.

Each individual clip 12, in a preferred embodiment, is an integral molded member symmetric about two orthogonal planes which intersect along a vertical axis through a central bore or opening 20 of the clip. The opening is dimensioned to receive and guide a fastener so that upon proper positioning of the clip with respect to the joist J and the adjacent deck planks P, the fastener 14 is driven through the clip into the joist J at a proper optimum position. The upper portion of the opening 20 has an outwardly tapered throat 22 to receive the head of the fastener upon driving. The lower portion of the opening 20 forms opposed axial slots 24.

The clip body has an upper planar platform 30 which laterally projects via opposed wings 32 to integrally connect with substantially identical elongated tongue-like retainers 40. The retainers 40 are each contoured for reception into the groove G of the adjacent deck plank in a tongue/groove interlocking engagement. The vertical spacing of the retainers is achieved by the vertical spacing above an underside 34 of the clip body defining a planar reference.

The lateral spacing dimension between the lateral sides 36 of the clip body essentially defines the proper spacing between adjacent deck planks of the installation. It is preferred that each retainer 40 be configured so that upon insertion into the groove G, the edge of a deck plank P is engaged by a side 36. It will be appreciated that the sides are preferably essentially planar and parallel.

Figure 2:
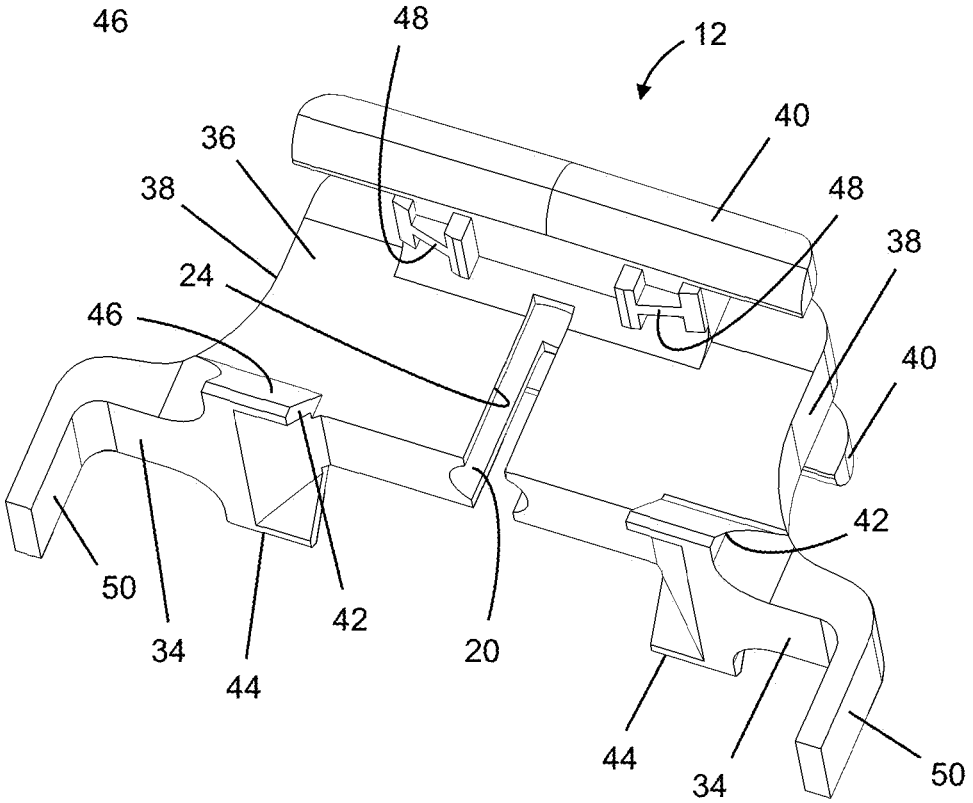
FIG. 2 is a generally bottom perspective view of the clip of FIG. 1.
Figure 3:
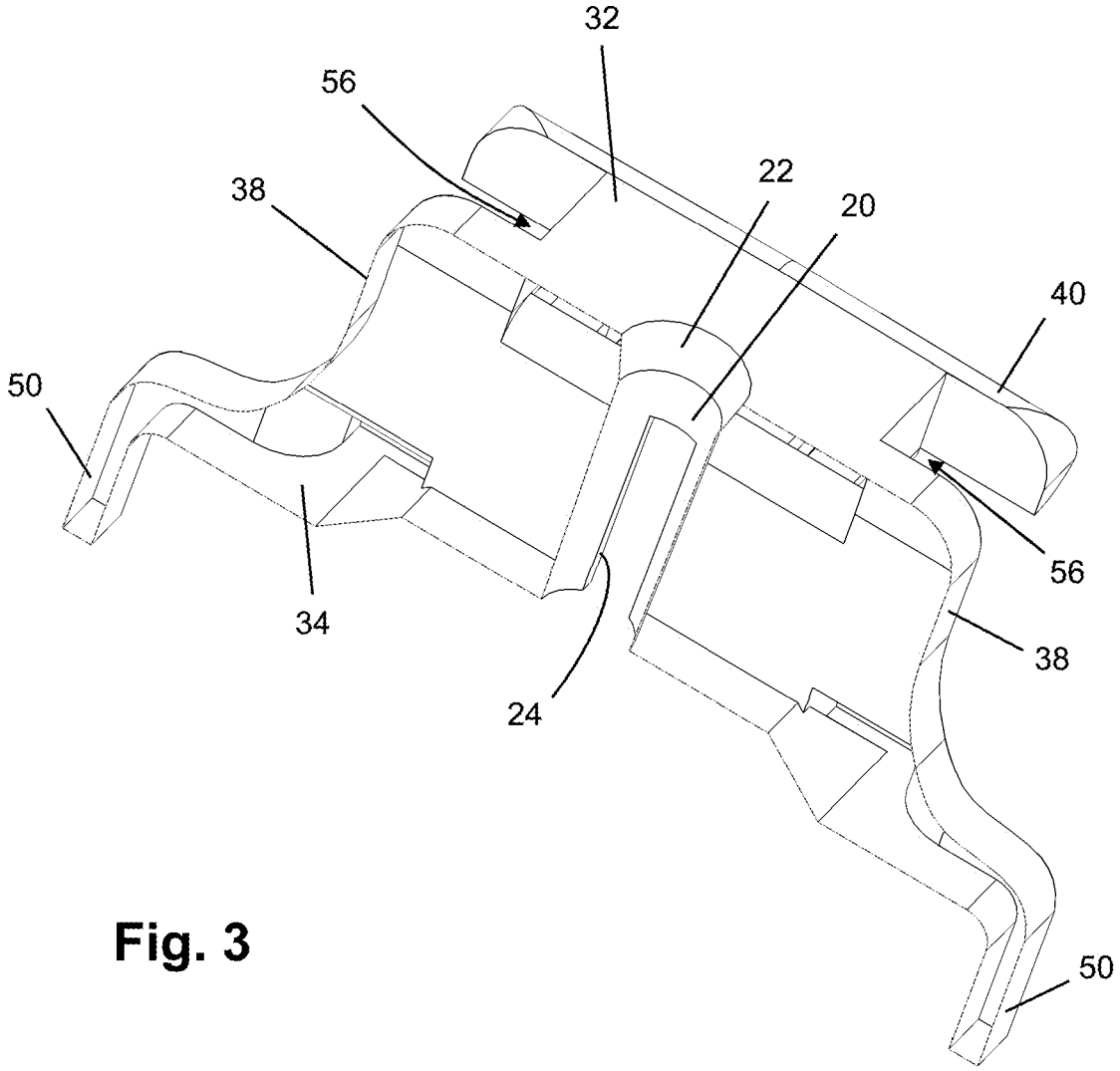
FIG. 3 is a central sectional perspective view of the clip of FIG. 1.
Figure 4:
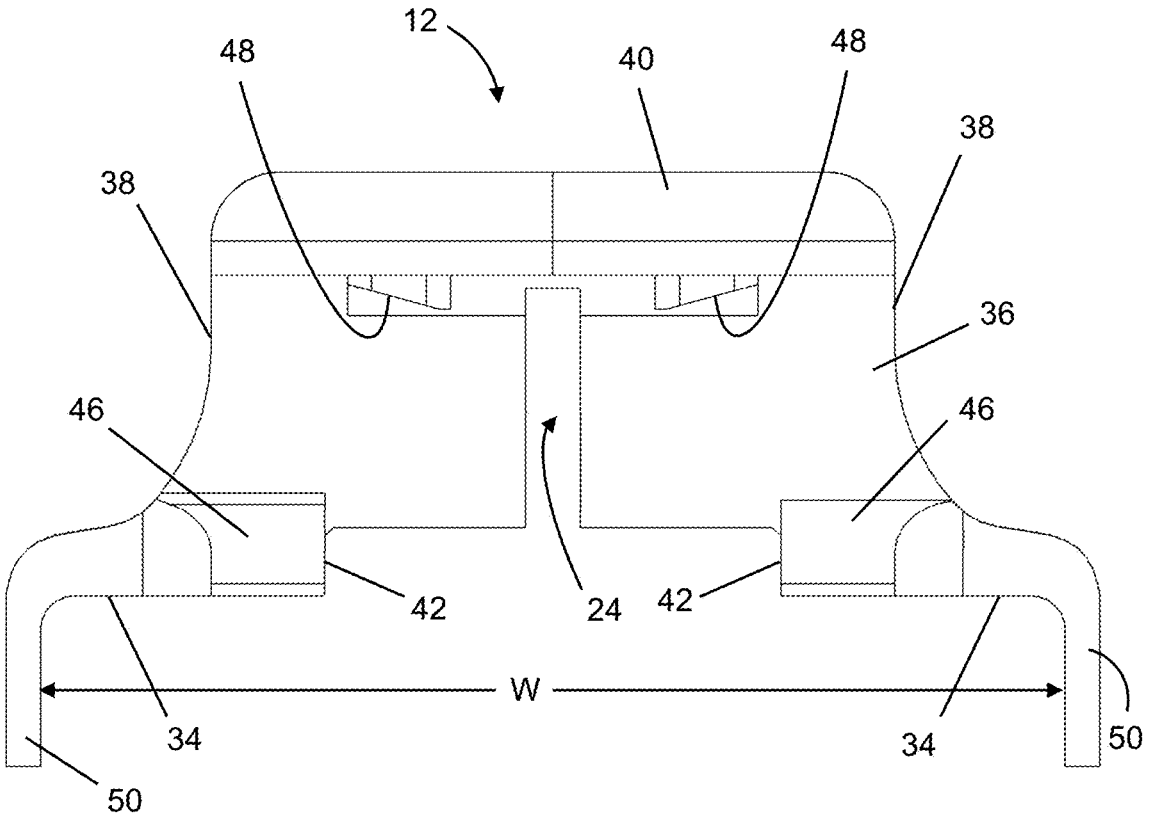
FIG. 4 is a side elevational view of the clip of FIG. 1.
Figure 5:
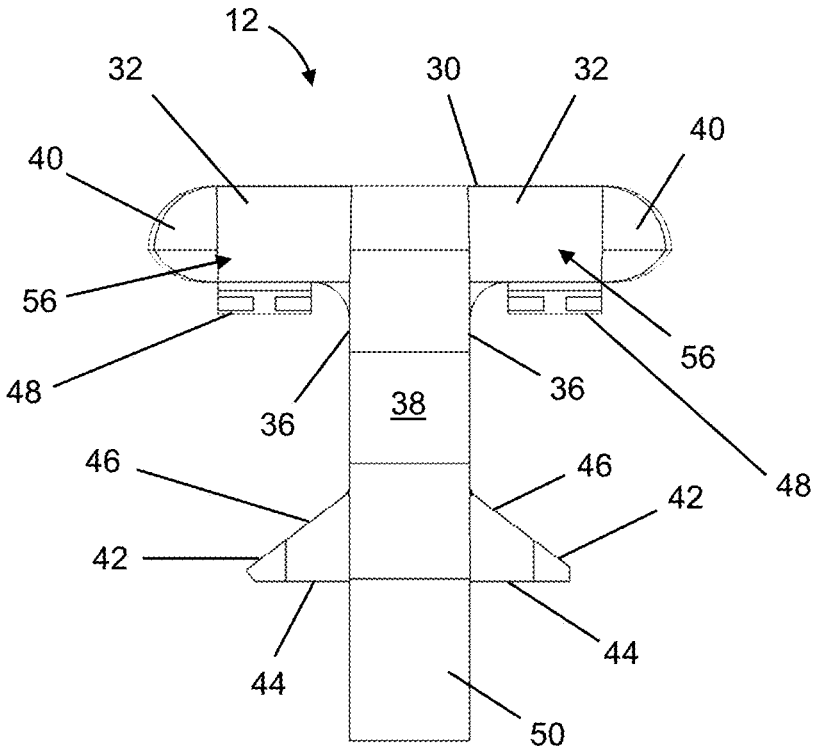
FIG. 5 is an end elevational view of the clip of FIG. 1.

The transverse edges 38 of the clip are configured so that they may be easily gripped by the fingers if it is desired to manually individually place and position the clip on the joist. The underside of the wings have laterally spaced pairs of teeth 48 which engage the adjacent upper surface of the plank P portion forming the lower surface of the groove G. The teeth have a slightly tapered I-shaped form which converges toward the central opening 20, as best illustrated in FIGS. 2 and 4.

Figure 6:
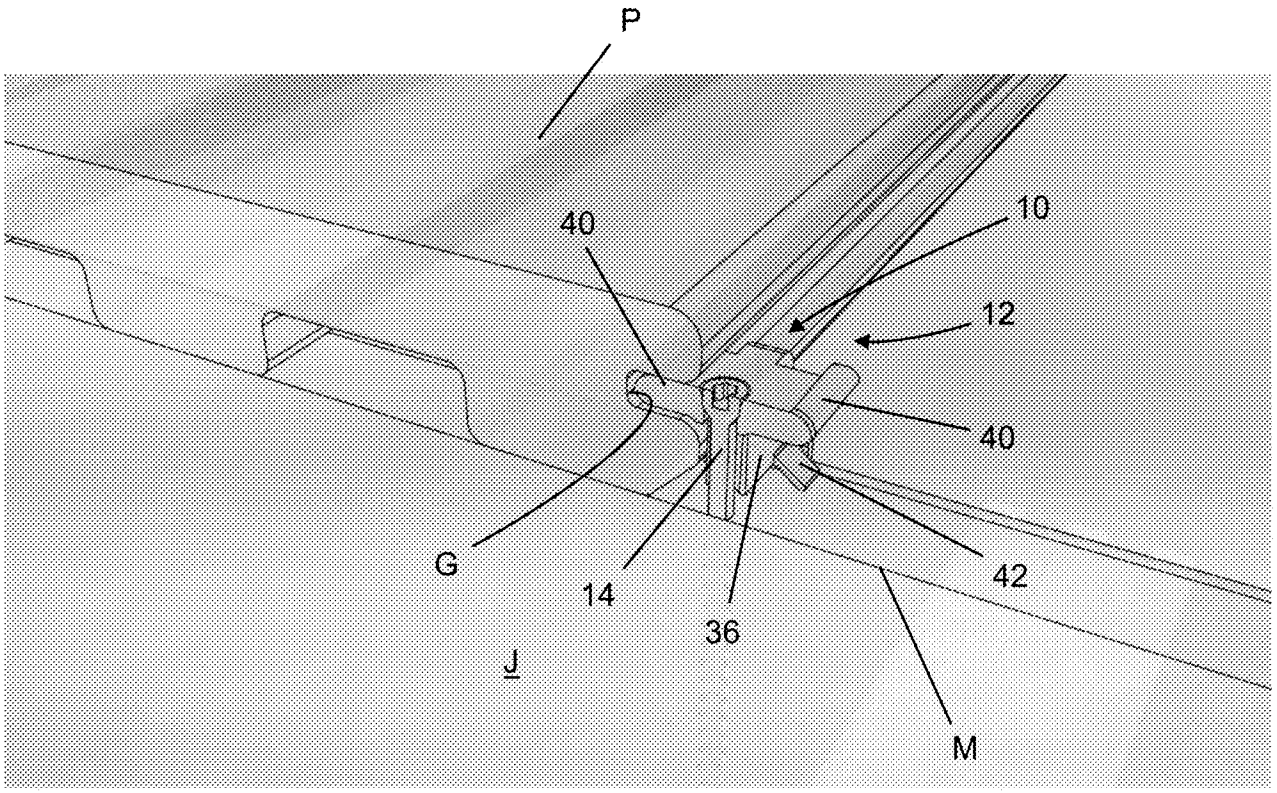
FIG. 6 is a perspective sectional view illustrating the clip of FIG. 1 and a fastener in an installed position securing a deck plank to a joist.

A pair of legs 50 integrally extend from the lower portion of the clip body and are spaced a distance substantially equal to the width W of the joist J. The legs have an L-shape section and are configured to capture or straddle the upper portion of the joist J. It will be appreciated that the legs at the inner surface engage opposed sides of the joist and the reference underside 34 rests on the top of the joist and the clip body sits generally atop the joist J. One half of the joist width W is illustrated in FIG. 6.

Two transversely spaced pairs of positioning shoulders 42 project laterally. The bottom surface 44 of each shoulder is coplanar with the reference underside 34. The top 46 of each of the shoulders is contoured generally complementary with the exterior lower edge surface of the deck plank P (which is typically significantly contoured) to snugly engage same.

The sides 36 of the clip, the edges of the wings 32 and the retainers 40 essentially define four indexing slots 56 to facilitate the proper alignment and adjustment of the clip and the collated strip of fastener assemblies when employed with an installation tool.

It will be thus appreciated that the clip 12, upon interlockable insertion of a retainer 40 into the groove G of the deck plank P, obtains the proper center or medial entry of the fastener into the joist J. The medial line M of the joist J is the section edge illustrated in FIG. 6. In addition, the opposing side of the clip thus also provides the proper positioning of the next adjacent deck plank which may be receivably positioned over the opposing retainer and secured in position by driving the fastener into the joist J.

Figure 7:
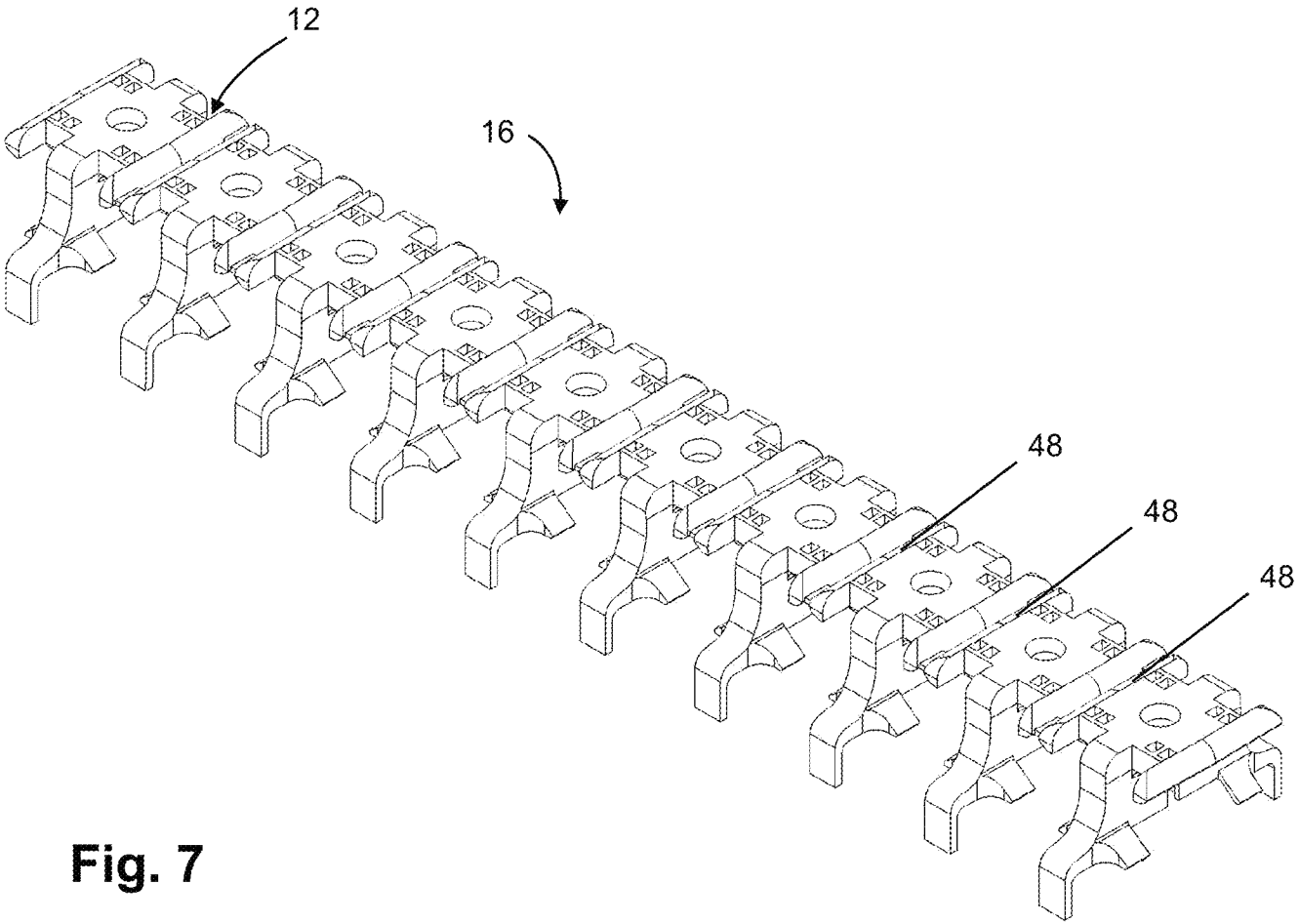
FIG. 7 is a perspective view of a linear strip of hidden clips.
Figure 8:
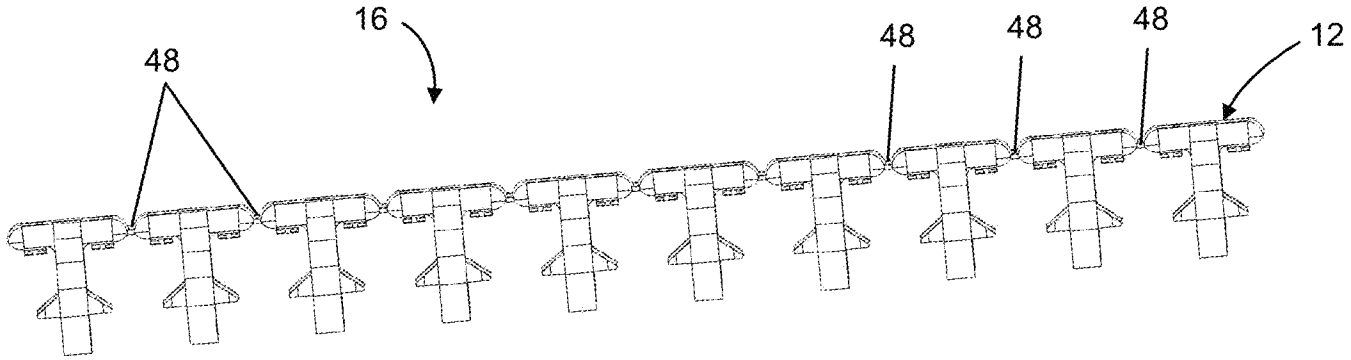
FIG. 8 is a side elevational view of the strip of hidden clips of FIG. 7.
Figure 9:
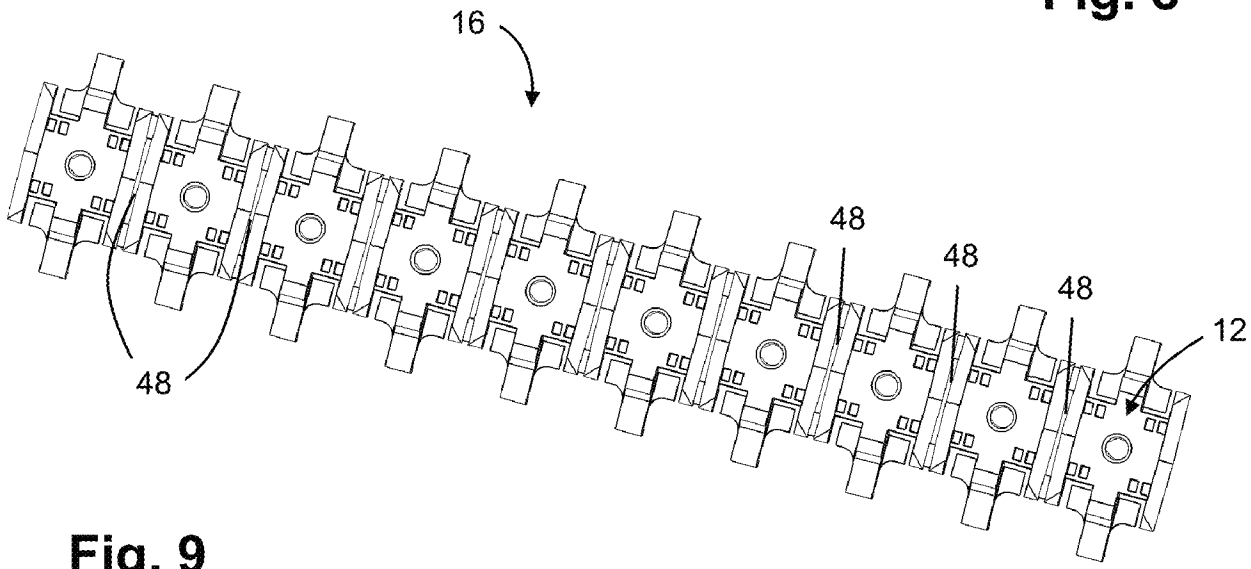
FIG. 9 is a top plan view of the strip of hidden clips of FIG. 7.
Figure 10:
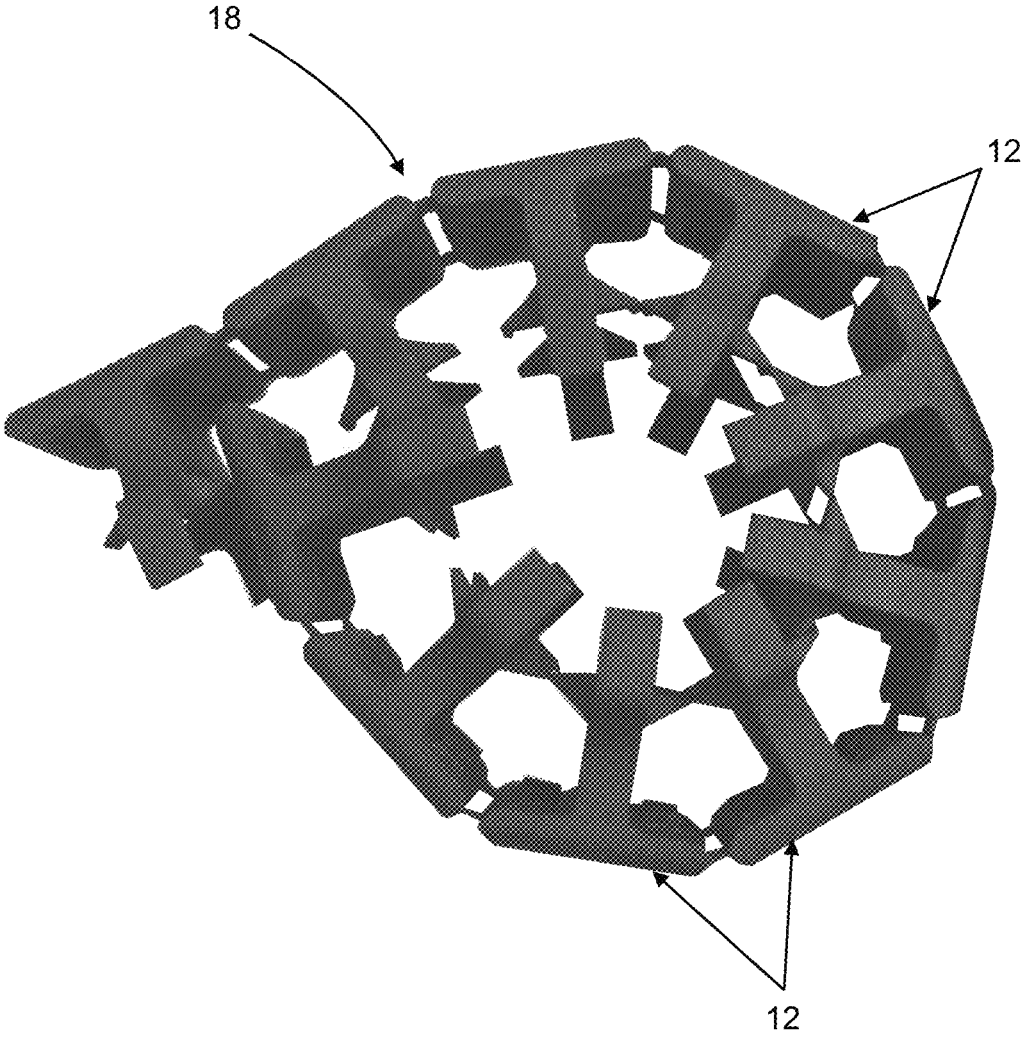
FIG. 10 is a side perspective view of the strip of FIG. 7 in a coiled configuration.

With reference to FIGS. 7-9, the clips 12 are preferably integrally joined in side-by-side strips 16 to facilitate both transportation of the clips to the worksite as well as to facilitate usage with an automatic advancement fastener and driving tool (not illustrated). Adjacent retainers 40 and adjacent clips are integrally connected by a thin connector 48 which is essentially severable. The number of joined clips may vary. In one embodiment illustrated in FIG. 10, multiple clips 12 are coiled into a compact envelope or spool 18 for packaging and transferring to the job site. The clips 12 may be relatively easily individually severed for handling and usage or the connected strips may be collated with an automatic advancement and driving tool (not illustrated).

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A clip for positioning and securing adjacent grooved planks to a joist having a width comprising:

a body having an upper platform and defining a central opening and having generally uniformly laterally spaced sides and a reference underside;

a pair of generally parallel transversely extending retainers laterally projecting outwardly relative to said sides and receivable in a plank groove;

a pair of spaced legs connecting the body and having portions laterally spaced a distance equal to the width of the joist and equidistantly spaced from said central opening; and two transversely spaced pairs of opposed shoulders, each shoulder extending from a side and having a lower surface coplanar with said reference underside, wherein the shoulders are spaced from the upper platform, and wherein the spaced sides extend between the upper platform and the reference underside;

wherein the clip is mountable to a joist so that the underside rests on the joist and opposed sides of the joist are captured between the legs, and a said retainer is received in a plank groove, and wherein a fastener received in the opening and driven into the joist secures the plank in position.

2. The clip of claim 1 wherein the opening has an enlarged upper throat and extends to the reference underside.

3. The clip of claim 1 wherein the body has transversely spaced edges contoured and configured to be easily manually gripped.

4. The clip of claim 1 wherein each retainer has a tongue-like shape with a contoured terminus.

5. The clip of claim 1 wherein said clip defines laterally spaced opposed pairs of indexing slots.

6. The clip of claim 1 wherein each shoulder has an upper tapered surface.

7. The clip of claim 1 wherein said clip is manufactured from a rugged plastic material.

8. The clip of claim 1 further comprising a fastener received in said opening.

9. A plurality of clips of claim 1 wherein adjacent retainers are joined by a connector to form a strip of clips.

10. The plurality of clips of claim 9 wherein the strip is wound into a spool.

11. A clip for positioning and securing adjacent grooved planks to a joist comprising:

a body having an upper end and an opposed reference underside and defining a central opening traversing from said upper end to said reference underside and having laterally spaced sides;

a pair of parallel transversely extending tongues projecting outwardly relative to said sides and being parallel to said reference underside;

a pair of L-shaped legs connecting the body and having lower portions equidistantly transversely spaced from said central opening; and at least one tapered shoulder extending from each side, wherein the shoulders are spaced from the upper end, and wherein the spaced sides extend between the upper end and the reference underside.

12. The clip of claim 11 wherein said body has a pair of laterally extending wings which integrally connect said tongues.

13. The clip of claim 12 further comprising a pair of teeth projecting downwardly from each said wing.

14. The clip of claim 11 wherein the at least one tapered shoulder extending from each side has a lower end portion coplanar with said reference underside.

15. The clip of claim 14 wherein there are two identical transversely spaced shoulders extending from each side.

16. The clip of claim 11 wherein said body, said wings and said tongues define four spaced indexing slots.

17. A deck assembly comprising a joist;

a plank having a groove positioned on said joist perpendicularly thereto;

a clip comprising a body having an upper end and an opposed reference end resting on said joist and a pair of legs connecting the body and straddling the joist, and having laterally spaced sides with a transversely extending tongue projecting outwardly relatively to each of said sides and one tongue extending into the groove with a side engaging said plank, and said body defining a central opening receiving a fastener which is driven into the joist to secure the plank to the joist, the clip further comprising a tapered shoulder extending from a side, wherein the shoulder is spaced from the upper end, and wherein the spaced sides extend between the upper end and the reference end.

18. The deck assembly of claim 17 wherein the tapered shoulder engages an underside edge portion of the plank.

19. The deck assembly of claim 17 further comprising at least one tooth extending downwardly from said clip and engaging a portion of said plank which defines said groove.

20. The deck assembly of claim 17 further comprising a second plank with a second groove disposed in adjacent parallel relationship to said plank and a tongue received in said second groove.

* * * * *